US006601300B2

(12) United States Patent
Hasegawa et al.

(10) Patent No.: US 6,601,300 B2
(45) Date of Patent: Aug. 5, 2003

(54) METHOD OF MANUFACTURING FUEL INJECTOR FOR INTERNAL COMBUSTION ENGINE

(75) Inventors: Hiroshi Hasegawa, Nagoya (JP); Takayuki Hokao, Anjo (JP); Masaaki Konishi, Chiryu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/087,783

(22) Filed: Mar. 5, 2002

(65) Prior Publication Data

US 2002/0124405 A1 Sep. 12, 2002

(30) Foreign Application Priority Data

Mar. 9, 2001 (JP) ..... 2001-066290

(51) Int. Cl.[7] ..... B21K 1/20

(52) U.S. Cl. ..... 29/890.128; 29/890.129; 29/890.131; 29/469

(58) Field of Search ..... 29/890.124, 890.126, 29/890.128, 890.129, 890.13, 890.131, 428, 445, 469, 90.01, 90.6, 255, 282, 234, 888.4; 219/121.11, 121.6, 59.1, 136, 121.63, 121.64; 251/129.2, 129.21, 129.22; 239/533.1, 533.2, 900, 585.4, 585.1, 585.2, 585.3

(56) References Cited

U.S. PATENT DOCUMENTS

| | | | | | |
|---|---|---|---|---|---|
| 4,651,926 | A | * | 3/1987 | Sasao et al. | 239/585.1 |
| 5,755,386 | A | * | 5/1998 | Lavan et al. | 239/585.4 |
| 5,927,613 | A | * | 7/1999 | Koyanagi et al. | 239/585.1 |
| 6,045,116 | A | * | 4/2000 | Willke et al. | 251/129.21 |
| 6,170,763 | B1 | * | 1/2001 | Fuchs et al. | 239/533.12 |
| 6,434,822 | B1 | * | 8/2002 | Perry et al. | 29/888.41 |

FOREIGN PATENT DOCUMENTS

| | | |
|---|---|---|
| JP | 11-117832 | 4/1999 |

* cited by examiner

*Primary Examiner*—Gregory Vidovich
*Assistant Examiner*—T. Nguyen
(74) *Attorney, Agent, or Firm*—Nixon & Vanderhye P.C.

(57) ABSTRACT

In a fuel injector, a valve unit consisting of a valve body and an injection plate is connected to a bottom end of a cylindrical housing. The valve unit is connected to the fuel injector after other components are assembled to the fuel injector. In the process of forming the valve unit, the valve body and the injection plate are coupled with each other, and then both are connected by welding. Then, the valve body having the injection plate welded thereto is inserted into a bottom end bore of the cylindrical housing, and then the valve body and the cylindrical housing are connected to each other by welding. A circular valve seat formed on the valve body is not deformed in the course of forming the valve unit and connecting the valve unit to the cylindrical housing.

4 Claims, 4 Drawing Sheets

METHOD OF MANUFACTURING FUEL INJECTOR FOR INTERNAL COMBUSTION ENGINE

CROSS-REFERENCE TO RELATED APPLICATION

This application is based upon and claims benefit of priority of Japanese Patent Application No. 2001-66290 filed on Mar. 9, 2001, the content of which is incorporated herein by reference.

BACKGROUND OF THE INVENTION

1. Field of the Invention

The present invention relates to a method of manufacturing a fuel injector for supplying fuel to an internal combustion engine.

2. Description of Related Art

A fuel injector supplies fuel to an internal combustion engine in a controlled manner. As shown in FIG. 1, a valve body and an injection plate having fuel injection holes are installed at a bottom end of a cylindrical housing. The injection holes are opened or closed according to reciprocal movement of a valve needle which is slidably disposed in the cylindrical housing to be electromagnetically driven.

In a conventional manufacturing method, the valve body is connected to the bottom end of the cylindrical housing by welding after other components are assembled together with the cylindrical housing. Then, the injection plate is welded to the bottom surface of the valve body. The conventional method of assembling the valve body and the injection plate to the cylindrical housing is shown in FIGS. 7–10.

As shown in FIG. 7, a valve body 100 is forcibly inserted into a bottom end of a cylindrical housing 101. Then, the valve body 100 is connected to the cylindrical housing 101 by performing laser-welding around the outer periphery of the cylindrical housing 101, as shown in FIG. 8. Then, as shown in FIG. 9, the bottom end of the valve body 100 is forcibly inserted into a sidewall 104 of a cup-shaped injection plate 102. Then, as shown in FIG. 10, the injection plate 102 is connected to the valve body 100 by performing laser-welding around the outer periphery of the side wall 104.

The valve body 100 has a circular hole and a circular valve seat 103 formed around the circular hole in a tapered shape. The circular valve seat has to closely abut the bottom end of the valve needle to close the injection holes formed on the injection plate 102. However, there has been a problem, in the conventional method described above, that the circular valve seat 103 is distorted and its roundness is not maintained. If the roundness of the circular valve seat 103 is not kept, the circular valve seat 103 does not correctly abut the bottom end of the valve needle, and thereby fuel leaks through the valve seat portion at a time fuel supply has to be stopped. If the fuel supply is not shut at the required timing, an air-fuel ratio cannot be properly controlled and quality of exhaust gas is adversely affected.

The roundness of the circular valve seat 103 is damaged in the conventional process because the valve body 100 is forcibly inserted into the inner bore of the cylindrical housing 101 and then both the valve body 100 and the cylindrical housing 101 are connected together by welding. Further, the bottom end of the valve body 100 having the circular valve seat 103 is forcibly inserted into the sidewall 104 of the injection plate 102 and then both are connected together by welding. The roundness of the circular valve seat 103 is damaged by those forcible insertion and welding processes.

SUMMARY OF THE INVENTION

The present invention has been made in view of the above-mentioned problem, and an object of the present invention is to provide an improved method of manufacturing a fuel injector, in which a roundness of a circular valve seat is correctly kept.

A fuel injector comprises a cylindrical housing in which a valve needle is slidably disposed and a valve unit connected to a bottom end of the cylindrical housing. The valve unit is composed of a ring-shaped valve body having a circular valve seat on which the valve needle seats and a cup-shaped injection plate connected to a bottom end of the valve body. All components of the fuel injector other than the valve unit are assembled separately from the valve unit, and the valve unit is connected to the assembled fuel injector.

In a process of forming the valve unit, a bottom end of the ring-shaped valve body is coupled with a cup-shaped injection plate having a flat bottom plate and a circular sidewall. An inner diameter of the circular sidewall is so made that the valve body is coupled with the injection plate without deforming the circular valve seat formed on the valve body. Then, a bottom plate of the injection plate is connected to the bottom surface of the valve body by welding the bottom plate to the bottom surface of the valve body. Then, the valve body to which the injection plate is welded is inserted into the bottom end bore of the cylindrical housing. Then, the valve body is connected to the cylindrical housing by welding the outer periphery of the cylindrical housing.

A process for adjusting a shape and a roundness of the circular valve seat may be additionally performed, if such is needed, after the injection plated is welded to the valve body and before the valve body is connected to the cylindrical housing. In the adjusting process, a round rod having an end corner surface coinciding with the circular valve seat is forcibly pressed against the circular valve seat, and the round rod is rotated. In this manner, the surface of the circular valve seat is smoothed and its roundness is improved. The round rod adjusting the circular valve seat is easily inserted into an inner bore of the valve body because the valve body is not yet connected to the cylindrical housing at this stage.

According to the present invention, the roundness of the circular valve seat formed on the valve body is not damaged by the process of coupling and welding the injection plate to the valve body because the valve body is not forcibly inserted into the injection plate. Further, the circular valve seat is not deformed in the process of inserting and welding the valve body to the cylindrical housing because the valve body is reinforced by the injection plate at this stage. Therefore, the valve needle is correctly seated on the circular valve seat to close injection holes without causing fuel leakage therebetween.

Other objects and features of the present invention will become more readily apparent from a better understanding of the preferred embodiment described below with reference to the following drawings.

DETAILED DESCRIPTION OF THE PREFERRED EMBODIMENT

Figure 1:
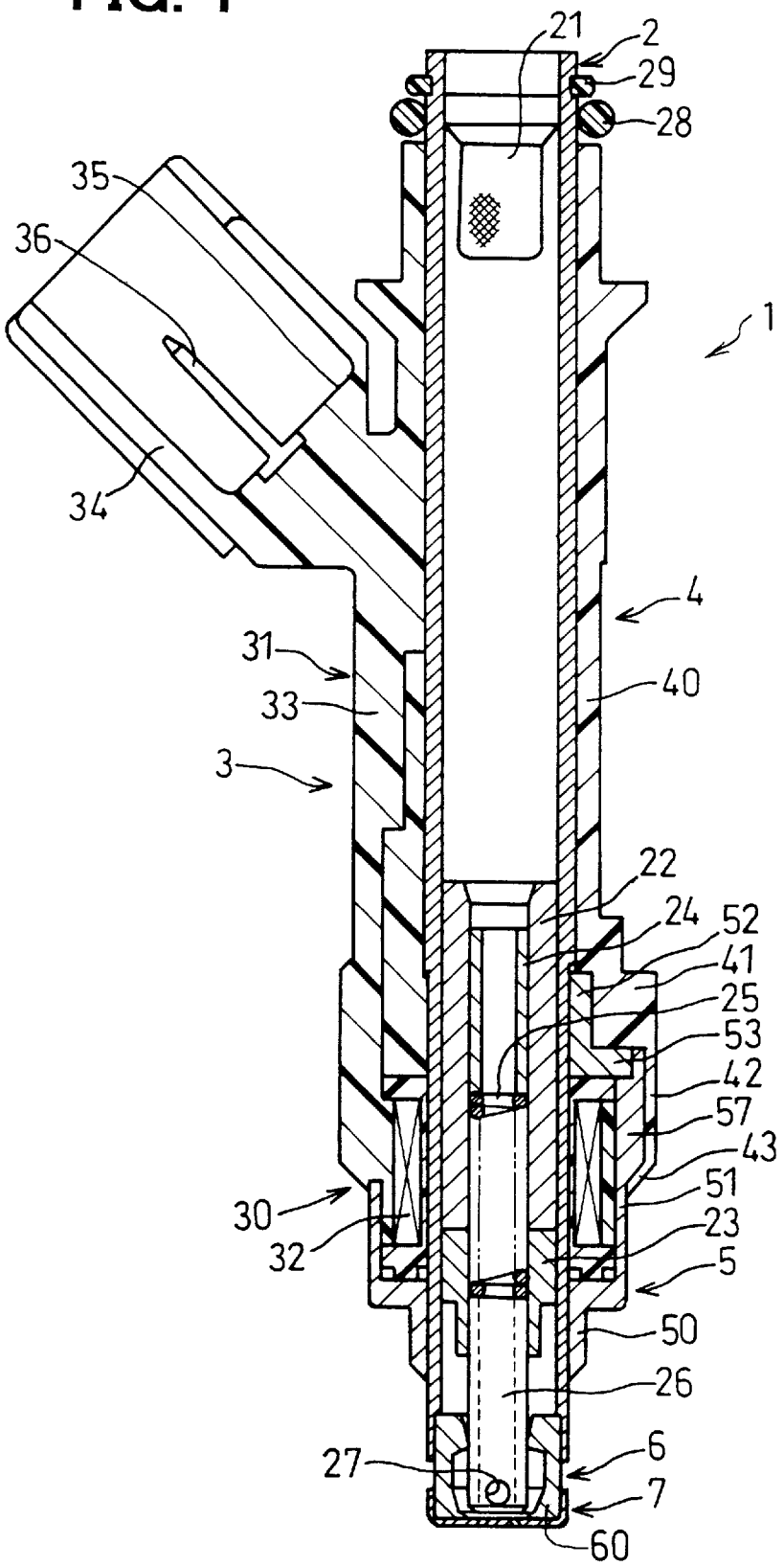
FIG. 1 is a cross-sectional view showing a fuel injector manufactured by a manufacturing method according to the present invention.

A preferred embodiment of the present invention will be described with reference to FIGS. 1–6. First referring to FIG. 1, an entire process of assembling a fuel injector 1 will be briefly explained. A fuel filter 21 is inserted into a top end of a cylindrical housing 2 and connected thereto by laser-welding. A stationary core 22 is forcibly inserted into an inner bore of the cylindrical housing 2 and connected to a downward portion of the cylindrical housing 2 by welding. An adjuster sleeve 24 is fixed to an upper portion of an inner bore of the stationary core 22 before the stationary core 22 is connected to the cylindrical housing 2. A spring 25 is inserted into the inner bore of the stationary core 22 so that an upper end of the spring 25 abuts the bottom end of the adjuster sleeve 24. A movable core 23 is inserted into the inner bore of the cylindrical housing 2 so that the movable core 23 slidably reciprocates therein. A lower end of the spring 25 is fixed to an inside portion of the movable core 23. A cylindrical valve needle 26 having a closed bottom end and a fuel hole 27 is fixedly connected to an inside portion of the movable core 23, before the movable core 23 is inserted into the cylindrical housing 2, so that the cylindrical valve needle 26 moves together with the movable core 23.

Then, a magnetic flange 5 having a small cylindrical portion 50 and a large cylindrical portion 51 is assembled to the cylindrical housing 2 so that an inner bore of the small cylindrical portion 50 closely contacts the outer periphery of the cylindrical housing 2. The magnetic flange 5 is connected to the cylindrical housing 2 by welding. A circular space is formed between the outer periphery of the cylindrical housing 2 and an inner wall of the large cylindrical portion 51. Then, an outer cover 3, formed by molding a resin material, having a bottom end 30 containing a ring-shaped coil 32 therein, a middle portion 33, a connector portion 31 and a terminal cover 34, is assembled to the cylindrical housing 2. The bottom end 30 is positioned in the circular space formed between the large cylindrical portion 51 of the magnetic flange 5 and the outer periphery of the cylindrical housing 2. The connector portion 31 of the outer cover 3 is positioned in contact with the outer periphery of the cylindrical housing 2. The terminal cover 34 slantedly branches out from the connector portion 31. A terminal 36 for supplying electric current to the coil 32 for driving the movable core 23 is formed on a bottom wall 35 of the terminal cover 34.

A C-shaped magnetic ring 52 including a flange portion 53 and an elongate portion 57 is connected to the outer periphery of the cylindrical housing 2, so that an bottom end of the elongate portion 57 abuts an upper end of the large cylindrical portion 51 of the magnetic flange 5. Then, a pair of C-shaped resin plates 4 is fixedly installed to cover the outside of the cylindrical housing 2. The C-shaped resin plate 4 includes an upper portion 40 having a smaller diameter, a middle portion 41 and a lower portion 42 having a larger diameter. The magnetic ring 52 is disposed in a space formed between the outer periphery of the cylindrical housing 2 and the middle portion 41. In a circular space formed between the lower portion 42 and the outer periphery of the cylindrical housing 2, the bottom end 30 of the outer cover 3 having the coil 32 and the flange portion 53 of the magnetic ring 52 are disposed. A bottom end 43 of the resin plate 4 is narrowed so that it engages with a tapered end of the elongate portion 57 to fix a longitudinal position of the resin plate 4. Finally, an O-ring 28 and a stopper ring 29 are inserted to the upper end of the cylindrical housing 2.

Figure 2:
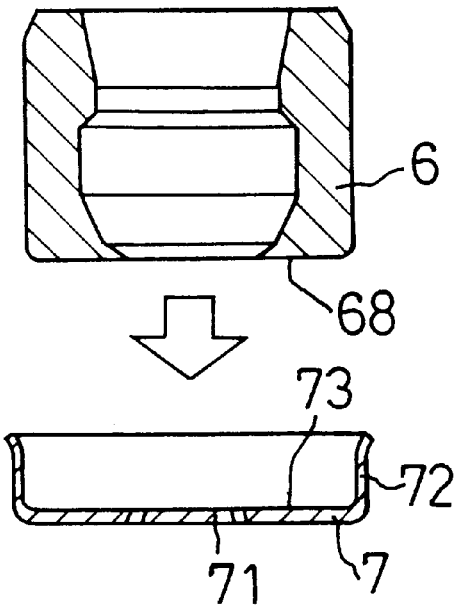
FIG. 2 is a cross-sectional view showing a process of coupling a valve body to an injection plate.

Separate from the above-described assembling process, a valve unit consisting of a valve body 6 and an injection plate 7 is formed in the following processes. First, as shown in FIG. 2, a cylindrical valve body 6 is coupled with a cup-shaped injection plate 7, so that a bottom surface 68 of the valve body 6 contacts an upper surface 73 of the injection plate 7. The injection plate 7 includes a bottom plate 71 through which injection holes are formed and a circular sidewall 72. An inside diameter of the sidewall 72 is made a little larger than an outer diameter of the valve body 6, so that both are coupled without forcibly inserting the valve body 6 into the sidewall 72 of the injection plate 7. Alternatively, the inside diameter of the sidewall 72 may be made so that it just fits the outer diameter of the valve body 6 and is coupled with the valve body 6 without deforming the valve body 6.

Figure 3:
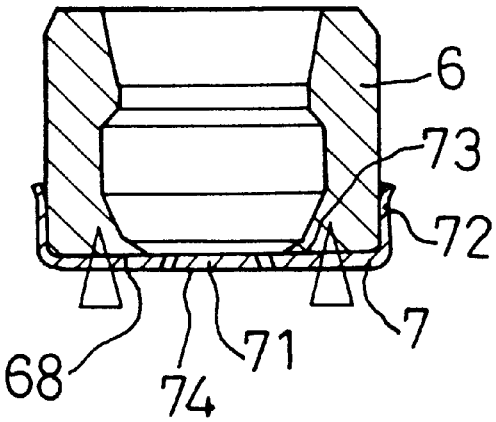
FIG. 3 is a cross-sectional view showing a process of connecting the valve body and the injection plate by welding.

Then, as shown in FIG. 3, the bottom surface 68 of the valve body 6 and the upper surface 73 of the injection plate 7 are connected together by performing welding, such as laser-welding, electron-beam-welding or arc-welding. The welding is performed from a lower surface 74 of the injection plate 7 along a circular welding path.

Figure 4:
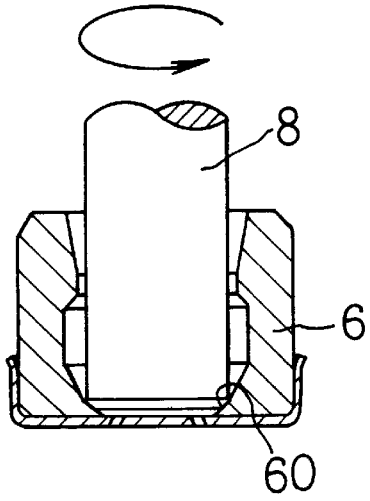
FIG. 4 is a cross-sectional view showing a process of adjusting a shape of a circular valve seat formed on the valve body.

Then, as shown in FIG. 4, a rod 8 is inserted in the inner bore of the valve body 6 so that a tapered peripheral end corner of the rod 8 abuts a circular valve seat 60 which is formed around a circular hole of the valve body 6 in a tapered shape. The tapered end corner of the rod 8 is formed to coincide with the shape of the circular valve seat 60. The inserted rod 8 is rotated while strongly pressing the circular valve seat 60 with the tapered end corner of the rod 8. In other words, the shape of the circular valve seat 60 is adjusted by a grinding action, and thus the roundness of the circular valve seat 60 is improved.

In the conventional process described in the related art section, the valve body is forcibly inserted into the inner bore of the cylindrical housing before the injection plate is welded to the valve body. Therefore, the roundness of the circular valve seat is damaged by the inserting force. On the contrary, according to the present invention, injection plate 7 is welded to the valve body before the valve body 6 is inserted into the inner bore of the cylindrical housing 2. The valve body 6 is reinforced by the injection plate 7 welded thereto. Further, the valve body 6 is not forcibly inserted into the sidewall 72 of the injection plate 7 in the process of the present invention, as opposed to that in the conventional process. Therefore, the process for adjusting the shape and roundness of the circular valve seat 60 may not be necessary in the manufacturing process of the present invention.

Moreover, the rod 8 for performing the adjusting process can be easily inserted into the inner bore of the valve body 6 in the process of the present invention, because the valve body 6 is not connected to the cylindrical housing 2 at this stage. On the contrary, in the conventional process, it is not easy to insert the adjusting rod at this stage, because the valve body is already connected to the cylindrical housing in which other components are already installed.

Figure 5:
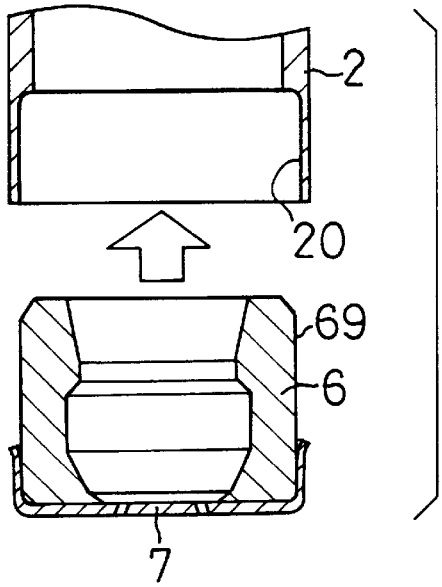
FIG. 5 is a cross-sectional view showing a process of inserting the valve body having the injection plate into a bottom end of a cylindrical housing.
Figure 6:
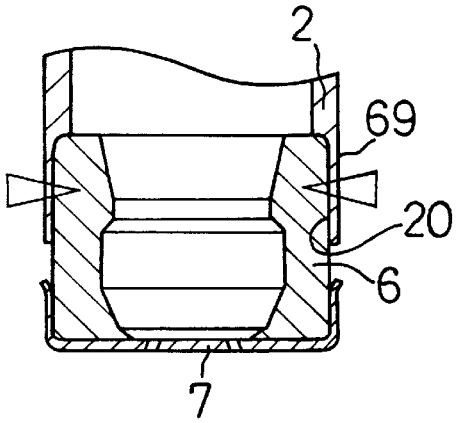
FIG. 6 is a cross-sectional view showing a process of connecting the valve body to the cylindrical housing by welding.
Figure 7:
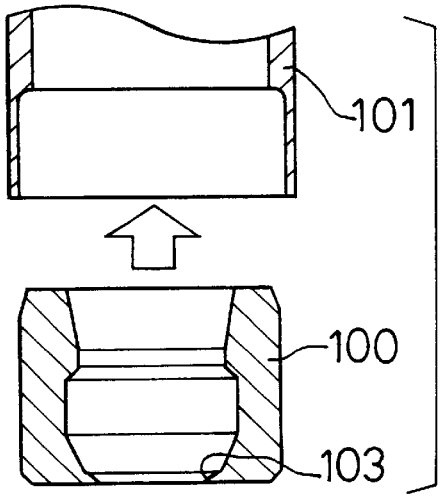
FIG. 7 PRIOR ART
FIG. 7 is a cross-sectional view showing a conventional process of inserting a valve body into a cylindrical housing.
Figure 8:
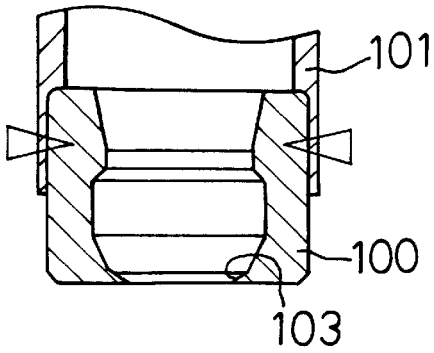
FIG. 8 PRIOR ART
FIG. 8 is cross-sectional view showing a conventional process of connecting the valve body to the cylindrical housing by welding.
Figure 9:
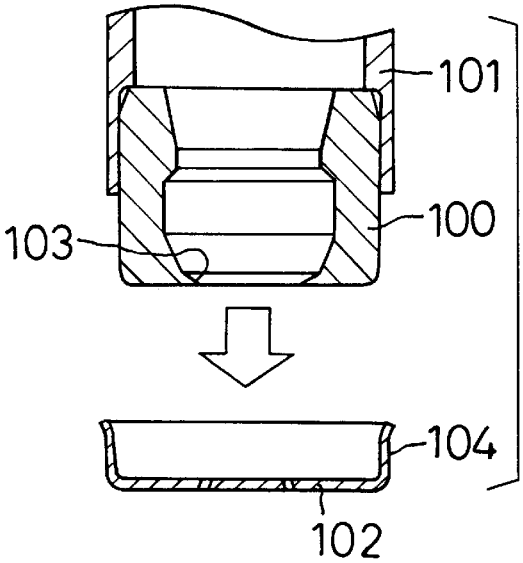
FIG. 9 PRIOR ART
FIG. 9 is a cross-sectional view showing a conventional process of inserting a bottom end of the valve body into an opening of a sidewall of the injection plate.
Figure 10:
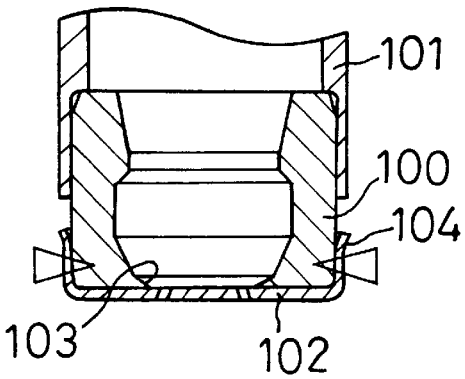
FIG. 10 PRIOR ART
FIG. 10 is a cross-sectional view showing a conventional process of connecting the injection plate to the valve body by welding.

After the injection plate 7 is welded to the valve body 6, an outer periphery 69 of the valve body 6 is forcibly inserted into the inner bore 20 of the cylindrical housing 2, as shown in FIG. 5. The circular valve seat 60 is not deformed by the inserting force because the valve body 6 is reinforced by the injection plate 7 as mentioned above. Then, the valve body 6 is connected to the cylindrical housing 2 by performing welding from the outer periphery of the cylindrical housing 2, as shown in FIG. 6. The welding may be done by laser-welding, arc-welding or electron-beam-welding.

The roundness of the circular seat 60 attained in the process of the present invention is compared with that obtained in the conventional process. The roundness obtained in the conventional process is measured after the valve body is inserted into the cylindrical housing and welded thereto and before the injection plate is welded, while the roundness attained in the process of the present invention is measured after a whole process is completed. The comparison test shows that the roundness of the circular valve seat is improved by the present invention by about 50 percents. This means that the valve body is considerably reinforced by the injection plate.

Advantages of the present invention are summarized as below. Since the valve body is inserted into the bottom end of the cylindrical housing after it is reinforced by the injection plate, the roundness of the circular valve seat is not damaged by the inserting force. Since the injection plate is not forcibly coupled to the valve body, the roundness of the circular valve seat is not adversely affected in the coupling process. Since the valve unit consisting of the valve body and the injection plate is formed separately from the processes of assembling other components, the process of adjusting the shape of the circular valve seat is easily carried out even if such adjustment is needed.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A method of manufacturing a fuel injector which comprises a cylindrical housing in which a valve needle is slidably disposed, a valve body connected to a bottom end of the cylindrical housing, and an injection plate connected to a bottom end of the valve body, wherein the valve body includes a circular valve seat on which the valve needle is seated, and the injection plate includes a bottom plate having injection holes which are opened and closed according to reciprocal operation of the valve needle and a circular sidewall, the method comprising steps of:

inserting the bottom end of the valve body into an inside space of the circular sidewall of the injection plate, an inner diameter of the circular sidewall being made not to deform the valve body;

connecting the bottom plate of the injection plate to the bottom end of the valve body by welding;

inserting an upper end of the valve body into the bottom end of the cylindrical housing; and connecting the valve body to the cylindrical housing by welding an outer periphery of the bottom end of the cylindrical housing.

2. The method of manufacturing a fuel injector as in claim 1, wherein:

the inner diameter of the circular sidewall is larger than an outer diameter of the bottom end of the valve body.

3. The method of manufacturing a fuel injector as in claim 1, further including a step of, the step being carried out before the step of inserting an upper end of the valve body into the bottom end of the cylindrical housing:

smoothing a surface of the circular valve seat and adjusting a roundness thereof.

4. The method of manufacturing a fuel injector as in claim 3, wherein:

in the smoothing and adjusting step, a round rod having an end corner surface corresponding to the surface of the circular valve seat is inserted into an inner bore of the valve body so that the end corner surface strongly presses the surface of the circular valve seat, and the round rod is rotated.

* * * * *